US011560778B2

(12) United States Patent
Grove et al.

(10) Patent No.: US 11,560,778 B2
(45) Date of Patent: Jan. 24, 2023

(54) ANNULAR VOLUME FILLER FOR PERFORATING GUN

(71) Applicant: Halliburton Energy Services, Inc., Houston, TX (US)

(72) Inventors: Brenden Michael Grove, Mansfield, TX (US); Richard Ellis Robey, Mansfield, TX (US); Christopher C. Hoelscher, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/370,255

(22) Filed: Jul. 8, 2021

(65) Prior Publication Data

US 2021/0332676 A1 Oct. 28, 2021

Related U.S. Application Data

(63) Continuation of application No. 16/509,806, filed on Jul. 12, 2019, now Pat. No. 11,078,761.

(60) Provisional application No. 62/733,405, filed on Sep. 19, 2018.

(51) Int. Cl.
*E21B 43/116* (2006.01)

(52) U.S. Cl.
CPC ..... *E21B 43/116* (2013.01)

(58) Field of Classification Search
CPC ... E21B 43/116; E21B 43/117; E21B 43/1195
See application file for complete search history.

(56) References Cited

U.S. PATENT DOCUMENTS

| | | | | |
|---|---|---|---|---|
| 2,980,017 | A * | 4/1961 | Castel | E21B 43/117 175/4.6 |
| 4,191,265 | A | 3/1980 | Bosse-Platiere | |
| 6,865,792 | B2 * | 3/2005 | Kash | E21B 43/117 29/455.1 |
| 6,865,978 | B2 * | 3/2005 | Kash | E21B 43/117 175/2 |
| 8,127,654 | B2 | 3/2012 | Williams et al. | |
| 8,794,326 | B2 | 8/2014 | Le et al. | |
| 10,060,234 | B2 | 8/2018 | Robey et al. | |

(Continued)

OTHER PUBLICATIONS

Korean Intellectual Propert Office, International Search Report and Written Opinion, PCT/us2019/041593, dated Nov. 11, 2019, 12 pages, Korea.

*Primary Examiner* — David Carroll
(74) *Attorney, Agent, or Firm* — John W. Wustenberg; C. Tumey Law Group, PLLC

(57) ABSTRACT

An apparatus and method according to which a perforating gun includes a volume fill body. The volume fill body is positioned in the space between a charge tube and a carrier tube. The fill body occupies at least part, and sometimes all, of the free volume space between the charge tube and carrier tube thereby reducing the free volume space. In certain downhole applications, large free volume space can lead to significant reductions in wellbore pressure, causing dynamic underbalance, which is undesirable. The presence of the volume fill body prevents, or at least reduces, dynamic underbalance and its effects. Also, the volume fill body aligns the charge tube with the carrier tube, further assisting perforation.

20 Claims, 8 Drawing Sheets

(56) References Cited

U.S. PATENT DOCUMENTS

| | | | | |
|---|---|---|---|---|
| 2005/0167108 | A1* | 8/2005 | Chang | E21B 43/1195 175/4.51 |
| 2010/0276136 | A1* | 11/2010 | Evans | E21B 43/117 166/55.2 |
| 2010/0319520 | A1* | 12/2010 | Williams | E21B 43/119 89/1.151 |
| 2012/0181026 | A1 | 7/2012 | Le et al. | |
| 2017/0145798 | A1* | 5/2017 | Robey | E21B 43/117 |
| 2018/0195372 | A1 | 7/2018 | Robey et al. | |

* cited by examiner

ANNULAR VOLUME FILLER FOR PERFORATING GUN

CROSS-REFERENCE TO RELATED APPLICATIONS

This application is a continuation of U.S. patent application Ser. No. 16/509,806, filed Jul. 12, 2019, which claims the benefit of the filing date of, and priority to, U.S. Patent Application No. 62/733,405, filed Sep. 19, 2018, the entire disclosures of which are hereby incorporated herein by reference.

TECHNICAL FIELD

The present application relates generally to the perforating of wellbores and more specifically to perforating guns having an open volume outside of the charge tube and inside the carrier tube.

BACKGROUND

Wellbores are typically drilled using a drill string with a drill bit secured to the lower free end and then, in the situation of cased-hole wells, completed by positioning a casing string within the wellbore and cementing the casing string in position. The casing increases the integrity of the wellbore and provides a flow path between the surface and selected subterranean formation for the injection of treating chemicals into the surrounding formation to stimulate production, for receiving the flow of hydrocarbons from the formation, and for permitting the introduction of fluids for reservoir management or disposal purposes.

Perforating has conventionally been performed by means of lowering a perforating gun on a carrier down inside the casing string. Once a desired depth is reached across the formation of interest and the gun is secured, the gun is fired. The gun may have one or many charges thereon which are detonated using a firing control, which may be activated from the surface via wireline or by hydraulic or mechanical means. Once activated, the charge is detonated to perforate (penetrate) the casing, the cement, and to a short distance, the formation. This establishes the desired fluid communication between the inside of the casing and the formation.

Typical hollow-carrier perforating guns used in service operations for perforating a formation generally include an elongated tubular outer housing in the form of a carrier tube within which is received an elongated tubular structure in the form of a charge tube. Explosive perforating charges are mounted in the charge tube and are ballistically connected together via explosive detonating cord. The charge tube is located relative to the carrier tube to align the shaped perforating charges with reduced-thickness sections of the carrier tube. In certain perforating gun system designs, the charge tube outer diameter (OD) is significantly smaller than the carrier tube inner diameter (ID). This can make it more difficult to axially align the charge tube within the carrier tube as compared to systems where the difference between the charge tube OD and the carrier tube ID is not as significant.

In such perforating gun system designs, where the charge tube has a comparatively small OD relative to the ID of the axially adjacent carrier tube, a significant annular volume (the space between the charge tube and carrier tube) is also exhibited within the gun. Specifically, a large proportion of the in-gun volume exists in the space between the charge tube OD and the carrier ID, contrasted with the relatively small proportion of in-gun volume within the charge tube ID between the charges themselves. In certain downhole applications, this large in-gun annular volume can lead to significant reductions in wellbore pressure (dynamic underbalance). This may cause any or all of the following effects: undesirable transient loads on the perforating and completion assemblies; perforation tunnel failure or collapse; or the production of excessive formation materials.

DETAILED DESCRIPTION

Figure 1:
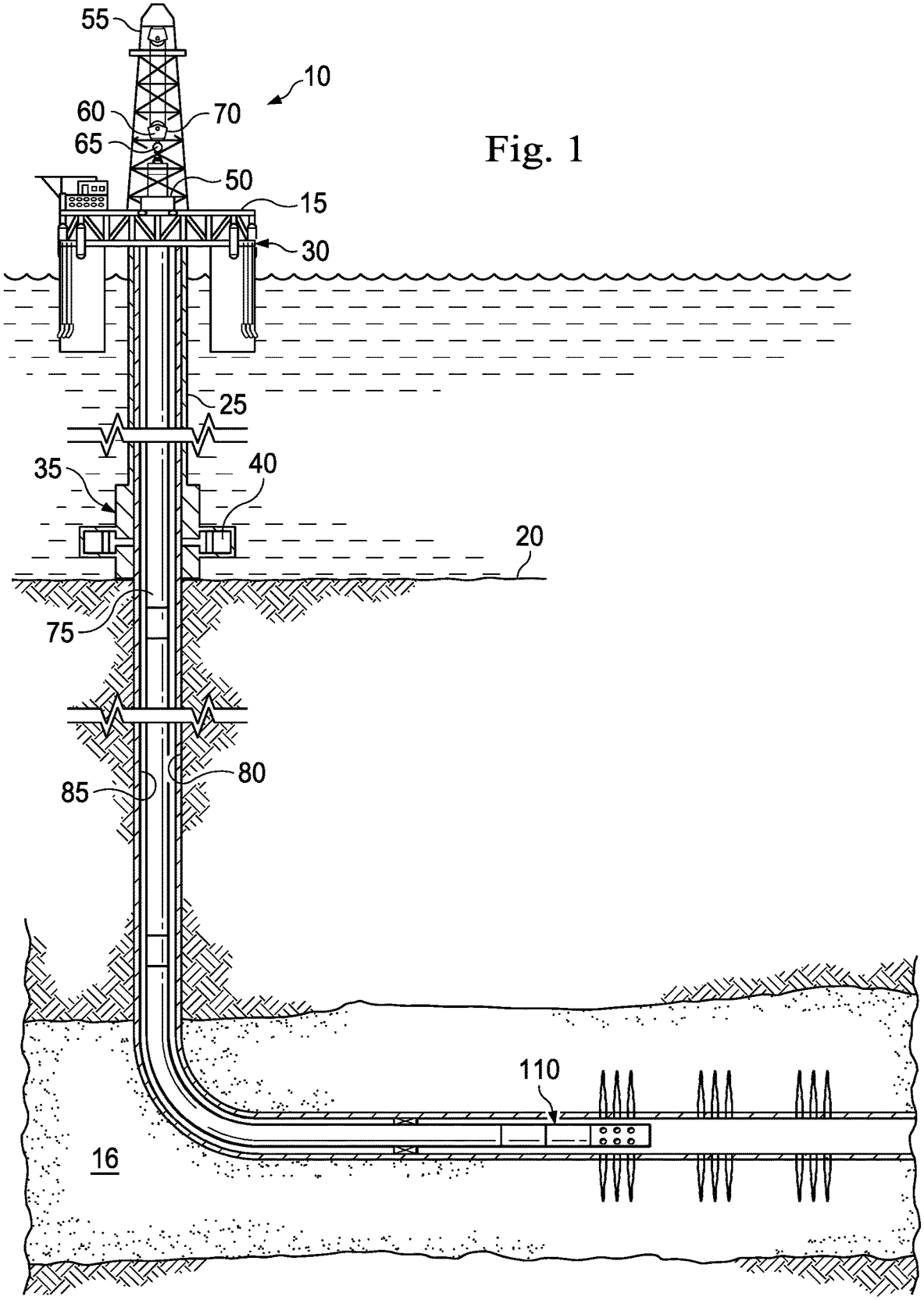
FIG. 1 is a schematic illustration of an offshore oil and gas platform operably coupled to a subsurface well system, according to one or more embodiments of the present disclosure.

The disclosure may repeat reference numerals and/or letters in the various examples or figures. This repetition is for simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the drawings is turned over, elements described as being "below" or "beneath" other elements or features would then be oriented "above" the other elements or features. Thus, the exemplary term "below" can encompass both an orientation of above and below. The apparatus may be otherwise oriented (i.e., rotated 90 degrees) and the spatially relative descriptors used herein may likewise be interpreted accordingly.

Disclosed herein are embodiments of a hollow-carrier perforating gun system having a charge tube disposed within a carrier tube with a solid fill body disposed in the annulus between the charge tube and the carrier tube in order to fill the free volume therebetween and to correctly align the charge tube with the carrier tube. In one or more embodiments, the fill body is a tube with a wall thickness greater than the wall thickness of either the fill tube or the carrier tube. In one or more embodiments, the fill body includes recesses adjacent each charge on the charge tube.

Referring to FIG. 1, in an embodiment, an offshore oil and gas rig is schematically illustrated and generally referred to by the reference numeral 10. In an embodiment, the offshore oil and gas rig 10 includes a semi-submersible platform 15 that is positioned over a submerged oil and gas formation 16 located below a sea floor 20. A subsea conduit 25 extends from a deck 30 of the platform 15 to a subsea wellhead installation 35. One or more pressure control devices 40, such as, for example, blowout preventers (BOPs), and/or other equipment associated with drilling or producing a wellbore may be provided at the subsea wellhead installation 35 or elsewhere in the system. The platform 15 may also include a hoisting apparatus 50, a derrick 55, a travel block 60, a hook 65, and a swivel 70, which components are together operable for raising and lowering a conveyance string 75. The conveyance string 75 may be, include, or be part of, for example, a casing, a drill string, a completion string, a work string, a pipe joint, coiled tubing, production tubing, other types of pipe or tubing strings, and/or other types of conveyance strings, such as wireline, slickline, and/or the like. The platform 15 may also include a kelly, a rotary table, a top drive unit, and/or other equipment associated with the rotation and/or translation of the conveyance string 75. A wellbore 80 extends from the subsea wellhead installation 35 and through the various earth strata, including the submerged oil and gas formation 16. At least a portion of the wellbore 80 includes a casing 85 cemented therein. The conveyance string 75 is, includes, or is operably coupled to a well system 110 extending within the wellbore 80 and the casing 85 at a subterranean location.

Figure 2:
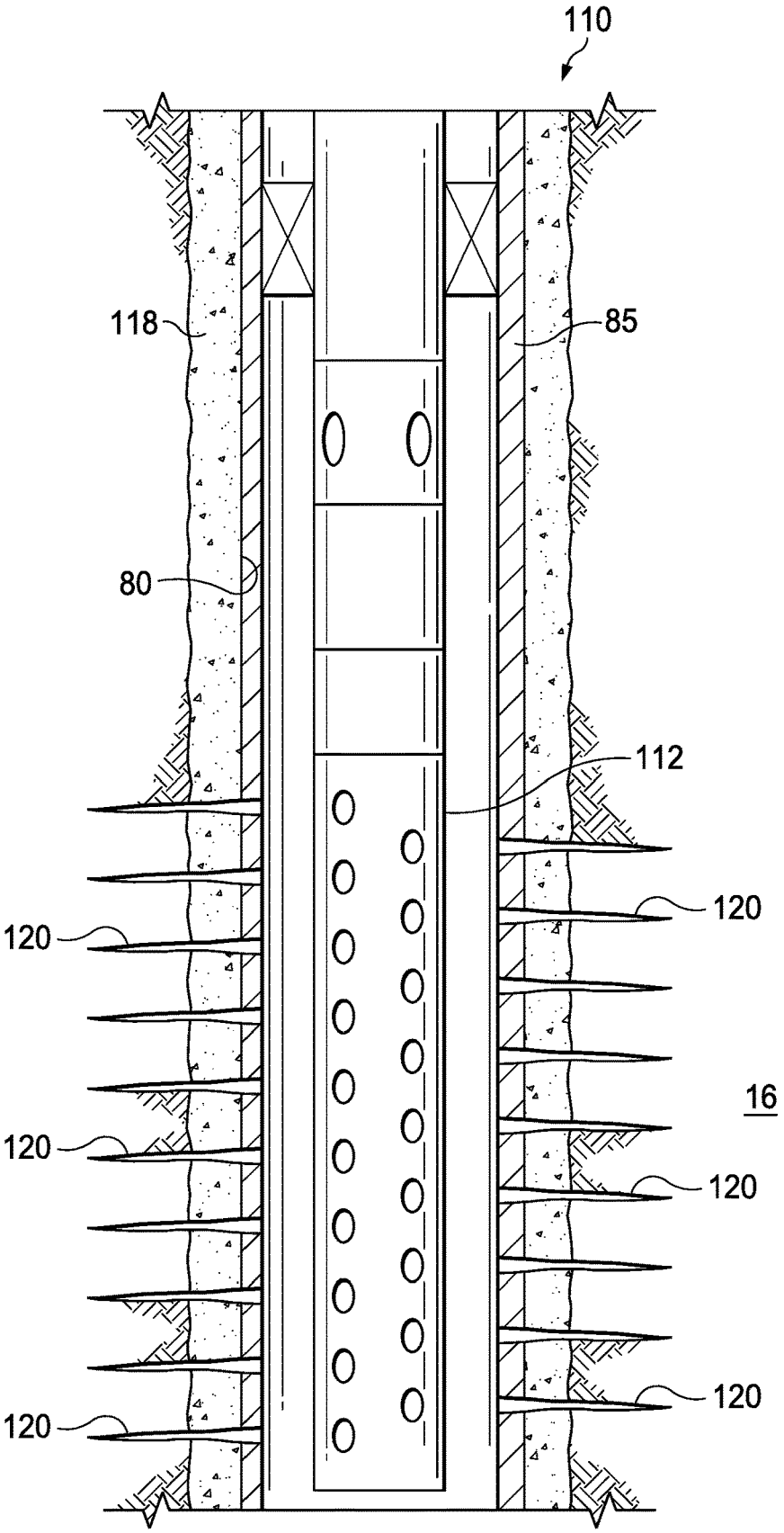
FIG. 2 is a cross-sectional view of the well system of FIG. 1, the well system including a perforating gun, according to one or more embodiments of the present disclosure.

Referring to FIG. 2, with continuing reference to FIG. 1, in an embodiment, the well system 110 includes a perforating gun 112. The perforating gun 112 extends within the wellbore 80, which is lined with the casing 85 and cement 118. The perforating gun 112 is operable to form perforations 120 through the casing 85 and the cement 118 so that fluid communication is established between the wellbore 80 and the submerged oil and gas formation 16 surrounding the wellbore 80. The perforating gun 112 includes perforating charges 124 (shown in FIG. 3A; not visible in FIG. 2) that are detonatable to form the perforations 120 through the casing 85 and the cement 118. After the perforating charges 124 are detonated, there is a reduction in pressure in the wellbore 80 due to fluids in the wellbore 80 flowing into the (detonated) perforating gun 112. It is not necessary that all components of the perforating gun 112 are separately constructed. Instead, one or more components of the perforating gun 112 can be integrated with one or more other components of the perforating gun 112. Accordingly, other perforating guns that do not includes each and every component of the perforating gun 112 described herein may nevertheless fall within the scope of the present disclosure.

Figure 3B:
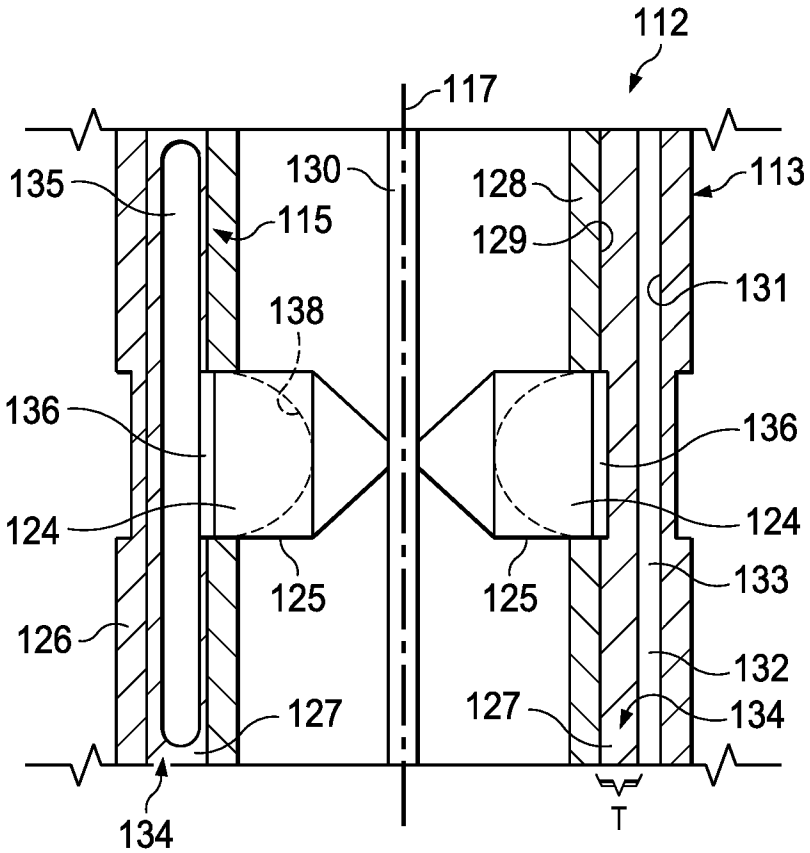
FIG. 3B is a cross-sectional view of the perforating gun of FIG. 2, the perforating gun including another fill body (or bodies), according to one or more embodiments of the present disclosure.
Figure 3A:
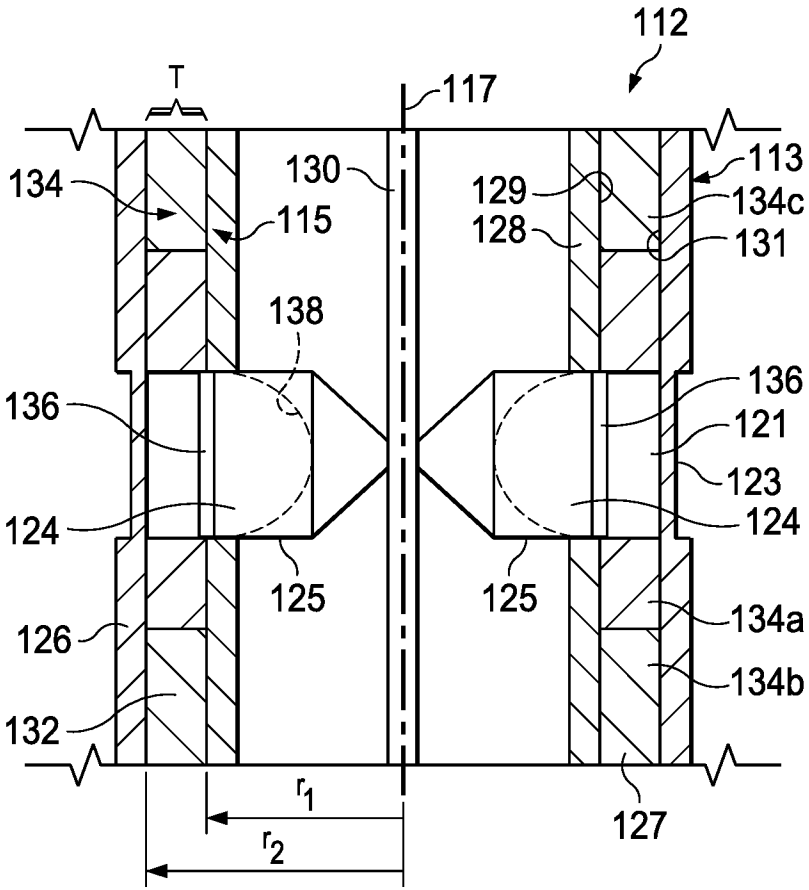
FIG. 3A is a cross-sectional view of the perforating gun of FIG. 2, the perforating gun including a fill body, according to one or more embodiments of the present disclosure.

Referring to FIG. 3A, with continuing reference to FIG. 2, in an embodiment, the perforating gun 112 includes a carrier tube 113 including a generally tubular outer body 126 extending along a central axis 117. A charge tube 115 including a generally tubular inner body 128 is positioned within the carrier tube 113 and extends generally along the central axis 117. The perforating charges 124 extend within the tubular inner body 128. A detonating cord 130 transfers a detonation train along a length of the perforating gun 112. In one or more embodiments, the perforating charges 124 are mounted within in the tubular inner body 128 so that, upon detonation of the charges 124, the tubular inner body 128 is not ruptured or otherwise damaged. Only a small axial section of the perforating gun 112 is depicted in FIG. 3A. Although two (2) of the perforating charges 124 are shown in FIG. 3A, in several embodiments, any number and/or arrangement of the perforating charges 124 may be used. Each of the charges 124 may be mounted in a charge carrier 125, which charge carrier 125 may at least partially extend from the tubular inner body 128. The charge carrier 125 is not necessarily tubular in form, since other shapes of the charge carrier 125 can be used in several embodiments.

The perforating gun 112 has a free gun volume that is occupied by fluid from the wellbore 80 after the perforating charges 124 are detonated. The free gun volume includes both a volume inside of the charge tube 115 and a volume 132 outside of the charge tube 115. The volume 132 is, includes, or is part of, an annular space between the carrier tube 113 and the charge tube 115. In one unique aspect of the well system 110, a portion of the volume 132 of the perforating gun 112 is reduced during make-up of the perforating gun 112. The volume 132 is the volume in the perforating gun 112 into which the well fluid may flow following detonation of the perforating charges 124. This volume 132 is typically sealed at atmospheric pressure prior to detonation of the perforating gun 112.

The volume 132 is reduced, as depicted in FIG. 3A, by the addition of a fill body 134 into the perforating gun 112 (e.g., of annular shape) around the charge tube 115. In several embodiments, the fill body 134 has an inner radius $r_1$ and an outer radius $r_2$. Although the fill body 134 is depicted in FIG. 3A as a thick-walled tube or elongated sleeve, especially as compared to the wall thickness of the charge tube 115, in several embodiments, the fill body 134 may be comprised of shorter sleeves in the form of annular rings, annular wedges, the like, or any combination thereof. Similarly, while the fill body 134 may be a single unitary body, in other embodiments, the fill body 134 is comprised of two or more sections, portions, or segments that together fill (or at least partially fill) the volume 132, such as is shown by a segment 134*a*, a segment 134*b*, and a segment 134*c* in FIG. 3A. In other embodiments, a plurality of axially positioned segments may form the fill body 134. These segments 134*a-c* may be made of the same material or different material, as desired. For example, the segment 134*a* adjacent the charge 124 may be made of a different material than the segments 134*b* and 134*c*. In particular, the segment 134*a* may be made of a plastic, while the segments 134*b* and 134*c* may be made of a metal, or vice-versa. In several embodiments, the fill body 134 may be or include other segments, sections, or portions that together form the fill body 134 around the charge tube 115. Such other segments, sections, or portions may be joined together or may simply be positioned to float freely around the charge tube 115. In some embodiments, at least one of segment comprises multiple parts, each of the multiple parts extending circumferentially around a portion of the charge tube 115 so that, in combination, the multiple parts together extend completely around a circumference of the charge tube 115 at a particular axial position. By filling (or at least partially filling) the volume 132, fluid from the wellbore 80 will have less volume to occupy in the perforating gun 112 after the charges 124 are detonated due to the presence of the fill body 134. The fill body 134 may include one or more recesses 121 (e.g., cut-outs) formed therein and aligned with the charges 124 carried by the charge tube 115. In several embodiments, the recesses 121 may enhance operation of perforating gun 112. In several embodiments, the recesses 121 may be aligned with one or more recesses 123 (e.g., reliefs) formed in the carrier tube 113 for a similar purpose.

Figure 5:
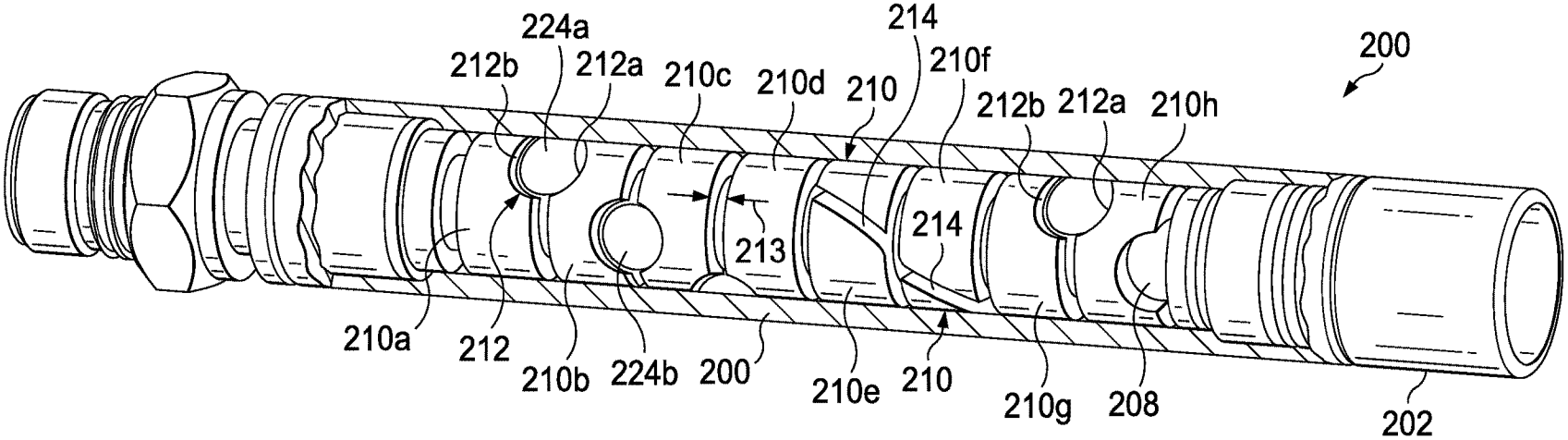
FIG. 5 is a perspective view of the perforating gun of FIG. 2, the perforating gun including a segmented fill body, according to one or more embodiments of the present disclosure.
Figure 6:
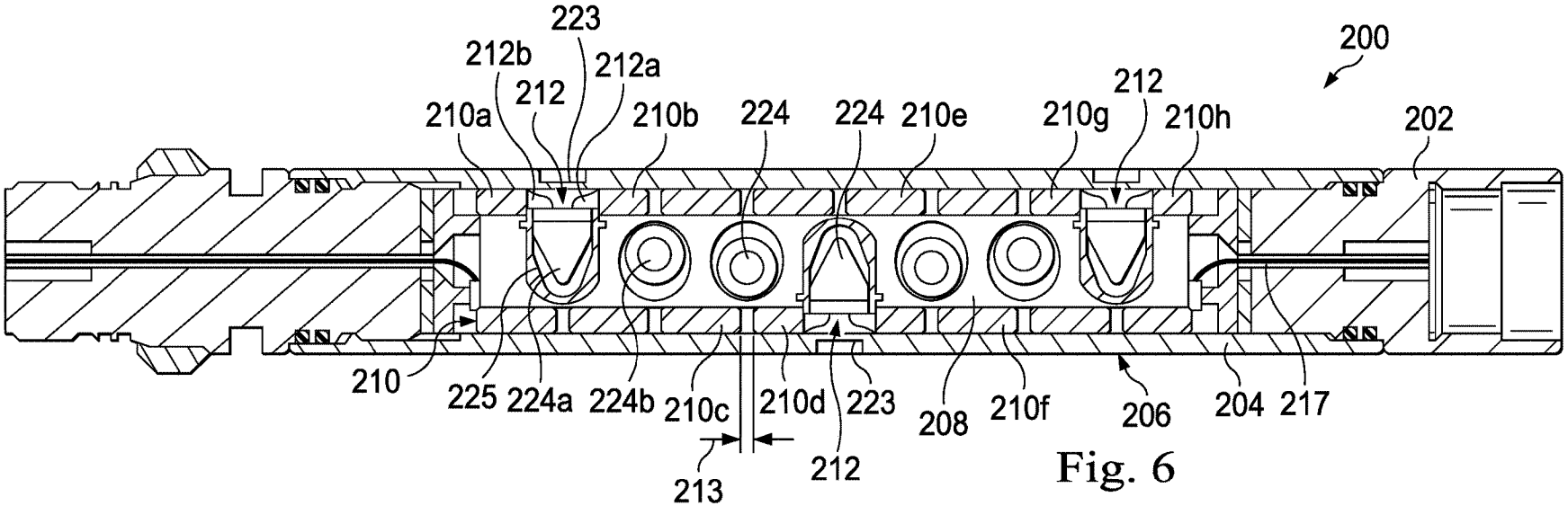
FIG. 6 is a cross-sectional view of the perforating gun of FIG. 5, according to one or more embodiments of the present disclosure.

The tubular inner body 128 of the charge tube 115 includes an annular wall 127 with an outer surface 129, while the tubular outer body 126 of the carrier tube 113 includes an inner surface 131. The fill body 134 has a radial thickness T. In several embodiments, the thickness T is selected to extend between the outer surface 129 and the inner surface 131 to completely fill the volume 132. Referring to FIG. 3B, the same perforating gun 112 is illustrated as in FIG. 3A, but with different configurations for the fill body 134. Thus, on the right side, the thickness T of the fill body 134 is less than the radial distance between the outer surface 129 of the charge tube 115 and the inner surface 131 of the carrier tube 113. Specifically, the thickness T may be selected to be less than the radial spacing between the outer surface 129 and the inner surface 131. In this regard, the inner radius $r_1$ of the fill body 134 may be larger than an outer radius (OD/2) of the charge tube 115 so as to create an annular gap between the charge tube 115 and the fill body 134, which may minimize a shock coupling between the charges 124, the charge tube 115, and the carrier tube 113. In addition, or instead, as shown in FIG. 3B, an annular gap 133 may be formed about an exterior of the fill body 134. In some instances, the annular gap between the charge tube 115 and the fill body 134, the annular gap 133 between the fill body 134 and the carrier tube 113, or both, may allow the fill body 134 to float between the carrier tube 113 and the charge tube 115. In addition, or instead, an axial gap or void may be formed between axially spaced apart segments, sections, or portions forming the fill body 134 (as shown in FIGS. 5 and 6) such that said lengthwise gap or void functions as a mechanism for reducing shock.

In several embodiments, the fill body 134 is a solid body, while in several embodiments, the fill body 134 may be a hollow body to reduce weight while still filling (or at least partially filling) the volume 132. For example, the fill body 134 is depicted as hollow on the left side of FIG. 3B, that is, a cavity 135 is formed in the wall 127 of the fill body 134. The volume of the cavity 135 may be selected based on the dimensions of the fill body 134. In this embodiment, the cavity 135 is shown adjacent the charge 124. In several embodiments, the fill body 134 may be solid and/or may include the one or more recesses 123 adjacent the charge 124 (as shown in FIG. 3A) while one or more of the cavities 135 are positioned along and within the fill body 134 at location (s) where detonation of the charge 124 will not rupture the one or more of the cavities 135.

Figure 4:
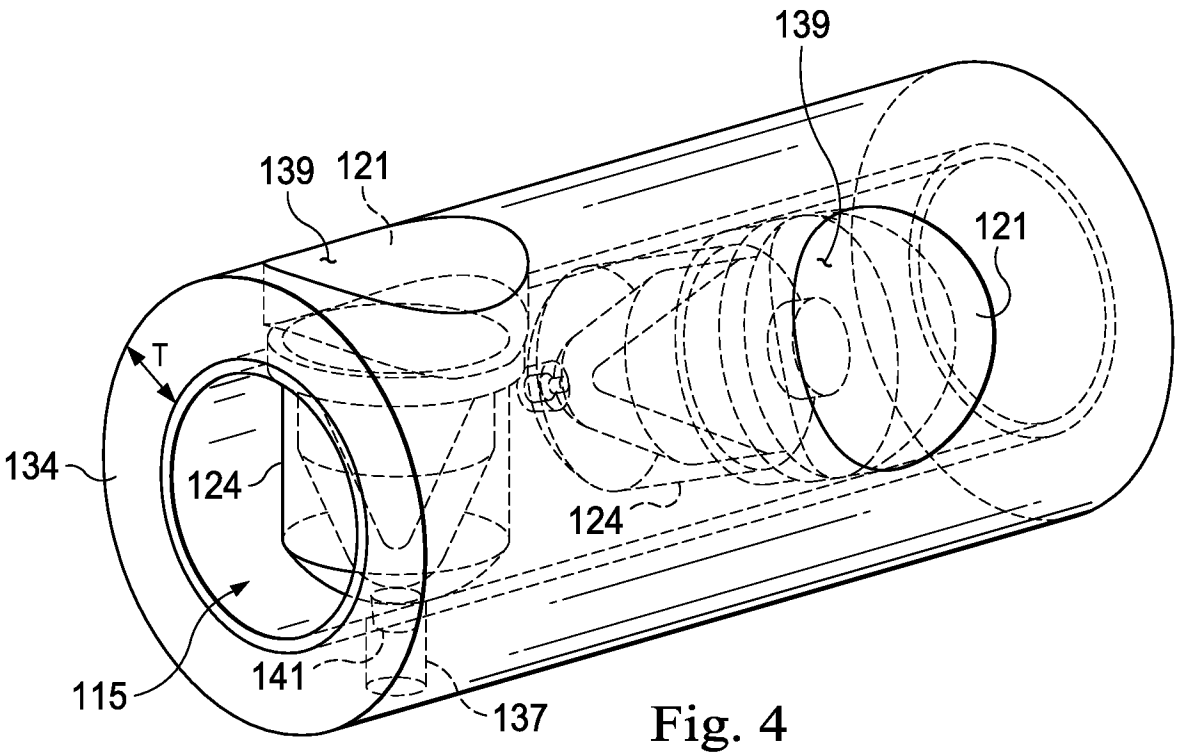
FIG. 4 is perspective view of a fill body and a charge tube of the perforating gun of FIG. 2, according to one or more embodiments of the present disclosure.

Referring to FIG. 4, the fill body 134 and the charge tube 115 are shown but the carrier tube 113 is omitted from view. More particularly, the fill body 134 is shown as having the thickness T, which is substantially greater than a thickness of the charge tube 115. The charges 124 are shown as being mounted in the charge tube 115. In this particular embodiment, the fill body 134 may include one or more recesses 121 formed in the wall 127 adjacent one or more of the charges 124, as shown. Similarly, one or more cavities 137 may be formed in the wall 127 of the fill body 134 as needed. The one or more cavities 137 may allow access to the charge tube 115 for cabling and/or a mechanism 141 used in association with the charge 124, such as a retaining mechanism, a shock mitigation mechanism, or a detonation mechanism (e.g., a primer button or detonation cord). In this regard, the cavity 137 may be coaxially aligned with the charge 124. The cavity 137 may be coaxially aligned with the recess 121 positioned adjacent the charge 124 to permit the primer button for the charge 124 to be positioned for activating the charge 124. The cavity 137 may be disposed in the annular wall 127 generally opposite the recess 121 formed in the wall 127 to permit a mounting, mitigation, or detonation mechanism to extend therein. In several embodiments, the cavity 137 may be or include a helical groove extending in a generally axial direction relative to the fill body 134 to accommodate detonation cord or cabling, a shock mitigation device, or a retaining device. In several embodiments, the fill body 134 can be integrally formed with the tubular inner body 128 of the charge tube 115.

In several embodiments, the one or more recesses 121 in front of the charges 124 can be filled (or partially filled) with appropriate material (e.g., different than the material from which the fill body 134 is formed) to minimize interference with performance of the charges 124. For example, the one or more recesses 121 may each include a cavity cover 139 having a domed interior and/or exterior with a small, centric hole to allow jet passage. The cavity covers 139 can be made of a different material than that of the fill body 134, such as a low density and/or lower/different shock impedance material as compared to the material from which the fill body 134 is made. In this regard, the fill body 134 as described herein may be made of any solid material (e.g., metal or plastic). In one embodiment, the metal may be selected from a group comprising aluminum, zinc, or steel. In several embodiments, the fill body 134 may be formed of a metal and the cavity covers 139 may be formed of plastic. In several embodiments, the fill body 134 may be formed of a rigid foam so long as the material will resist the pressures and temperatures of fluids to which it is exposed downhole.

Referring to FIGS. 5 and 6, a perforating gun 200 is illustrated and generally includes a firing head 202 secured to a first end 204 of a carrier tube 206 (such as the carrier tube generally described above). Disposed within the carrier tube 206 is a charge tube 208 in which charges 224 are mounted. Fill bodies 210 (generally with suffixes a-h) are positioned (e.g., annularly) between the charge tube 208 and the carrier tube 206. In several embodiments, each of the fill bodies 210 is comprised of one or more segments (shown in FIG. 11). Adjacent ones of the fill bodies 210, such as the fill bodies 210*a* and 210*b*, may be shaped to cooperate with one another so as to form recesses 212 (e.g., cut-outs). In this regard, in several embodiments, the fill bodies 210 each overlap a pair of the charges 224. For example, each of the fill bodies 210 may be disposed axially along the charge tube 208 between successive ones of the charges 224, such as the charges 224*a* and 224*b*. Accordingly, each of the fill bodies 210 may include partial recesses 212*a* and 212*b* formed at opposing end portions of the fill body 210 so that the partial recesses 212*a* and 212*b* of adjacent ones of the fill bodies 210 together make up one of the recesses 212 over a corresponding one of the charges 224.

While adjacent ones of the fill bodies 210 may abut one another, in several embodiments, an axial void space 213 is instead formed between adjacent ones of the fill bodies 210. The axial void space 213 may be filled with a spacer material selected to create a shock impedance mismatch with respect to the adjacent ones of the fill bodies 210. In several embodiments, such spacer material in the axial void space 213 may be low density solids, foams, the like, or any combination thereof. The void space 213 is variable in size by adjusting respective lengths of the fill bodies 210. In this regard, the fill bodies 210 may be produced with differing lengths to vary the available free gun volume outside the charge tube 208 and resulting in a highly adjustable free gun volume.

In addition to the recesses 212, one or more of the fill bodies 210 may include a groove 214 formed therein to allow a detonation cord to extend across the fill body 210. Because the charges 224 are generally helically arranged along the length of the perforating gun 200, in one or more embodiments, the groove 214 may likewise be helical along the length of the fill body 210 from one end of the fill body 210 to the other, such that when a plurality of the fill bodies 210 are positioned adjacent one another, a helical path for a detonation cord 217 (shown in FIG. 6) is formed along a portion of the length of the perforating gun 200. As best illustrated in FIG. 6, a charge carrier 225 may at least partially extend from the charge tube 208 for each of the charges 224. Recesses 223 (e.g., reliefs) may be formed in the carrier tube 206 and generally aligned with each of the charges 224.

Figure 7:
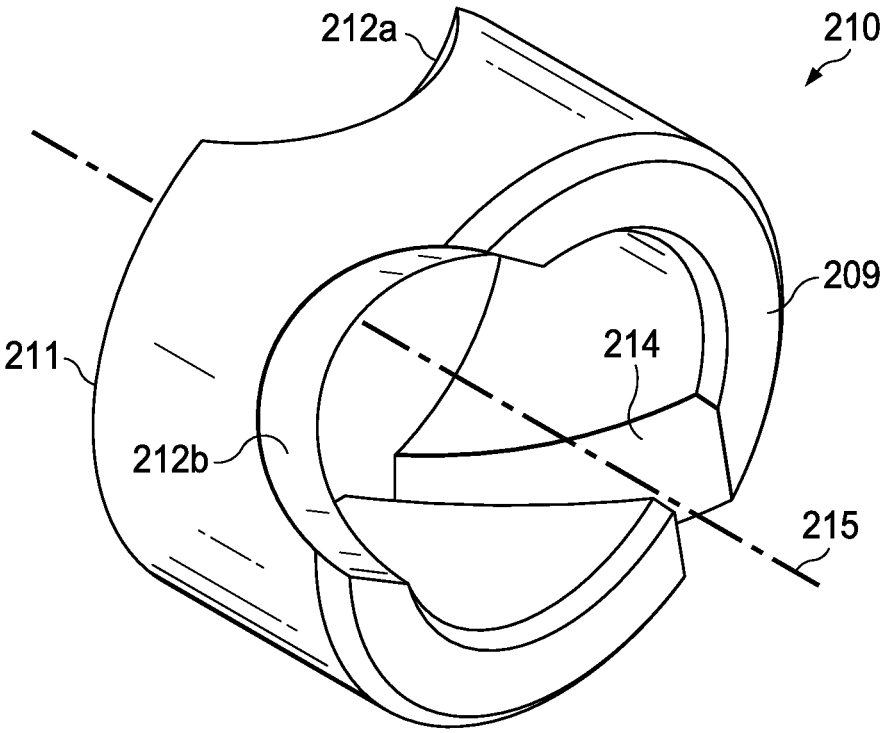
FIG. 7 is a perspective view of a segment of the segmented fill body of FIG. 5, according to one or more embodiments of the present disclosure.
Figure 8:
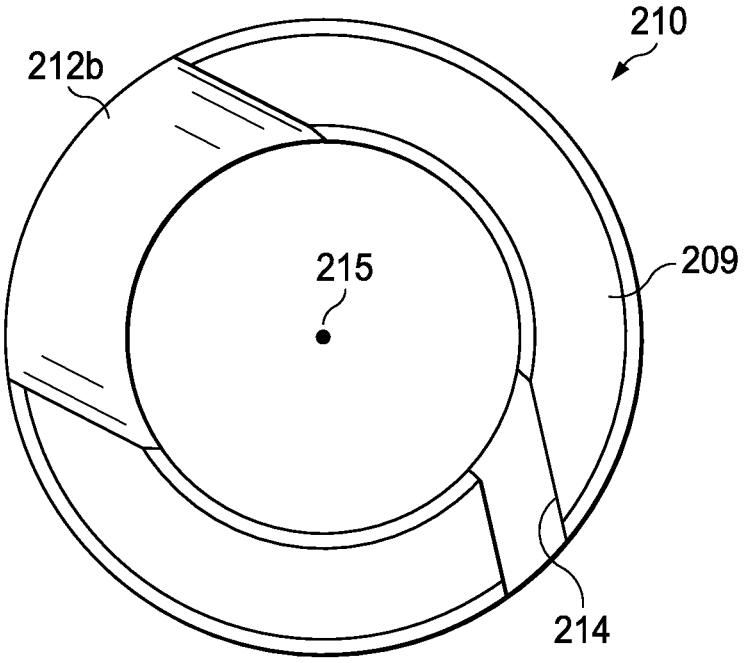
FIG. 8 is an elevational view of the fill body segment of FIG. 7, according to one or more embodiments of the present disclosure.

Referring to FIGS. 7 and 8, in an embodiment, the fill bodies 210 are each formed in the general shape of a short sleeve or ring. More particularly, the fill bodies 210 each include opposing end portions 209 and 211. The partial recess 212*a* is formed at the end portion 211 and the partial recess 212*b* is formed at the end portion 209. In several embodiments, the partial recesses 212*a* and 212*b* are circumferentially offset from one another about a central axis 215 of the fill body 210. In several embodiments, each partial recess 212*a* and 212*b* may be generally semi-circular in shape so that the partial recesses 212*a* and 212*b* of adjacent ones of the fill bodies 210 together make up a circular one of the recesses 212 over a corresponding one of the charges 224. In addition, the groove 214 extends between the opposing end portions 209 and 211 of the fill body 210. The groove 214 may be helical, as shown. Turning again to FIGS. 5 and 6, the fill bodies 210 are shown deployed in the perforating gun 200, as generally described above.

Figure 9:
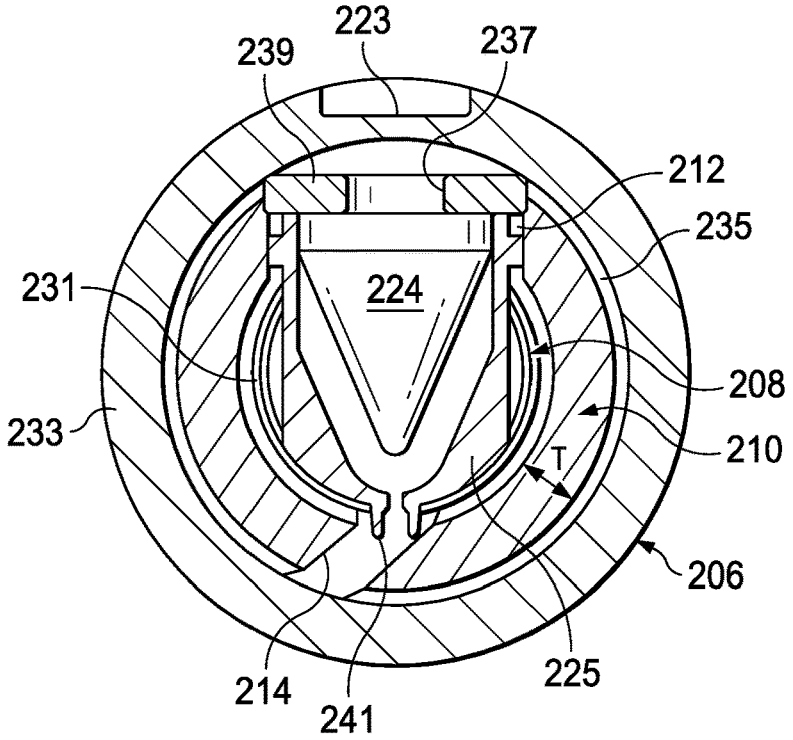
FIG. 9 is a cross-sectional view of the perforating gun of FIG. 6 taken along the line 9-9 of FIG. 6, according to one or more embodiments of the present disclosure.

Referring to FIG. 9, with continuing reference to FIGS. 5 and 6, a cross-sectional end view of the perforating gun 200 is illustrated. The charge tube 208 is shown generally axially aligned within the carrier tube 206. The charge tube 208 includes a thin annular wall 231 as compared to a thicker annular wall 233 of the carrier tube 206. Disposed in an annulus 235 between the charge tube wall 231 and the carrier tube wall 233 is one of the fill bodies 210. The thickness T of the fill body 210 may be selected to fill all or a portion of the annulus 235 between the carrier tube 206 and the charge tube 208. The recess 212 is formed in the fill body 210 and may be shaped to accommodate the charge carrier 225 at least partially extending from the charge tube 208. The charge carrier 225 is disposed to receive the charge 224 for detonation. In several embodiments, the recesses 212 may be aligned with respective ones of the recesses 223 formed in the carrier tube 206.

The groove 214 may be formed in the fill body 210 generally opposite the recess 212 and disposed for receipt of a mechanism 241 used in association with the charge 224, such as a retaining mechanism, a shock mitigation mechanism, or a detonation mechanism (e.g., a primer button or detonation cord). A cavity cover 239 is shown deployed over the recess 212. The cavity cover 239 may include a domed interior and/or exterior and may further include a centrally located aperture 237 to allow jet passage. It will be appreciated that the cavity cover 239 also functions as a volume filler adjacent the charge 224 and may be made of a metal such as steel, aluminum, zinc, and/or magnesium, or a low-density material such as a polymer and/or a foam.

Figure 10:
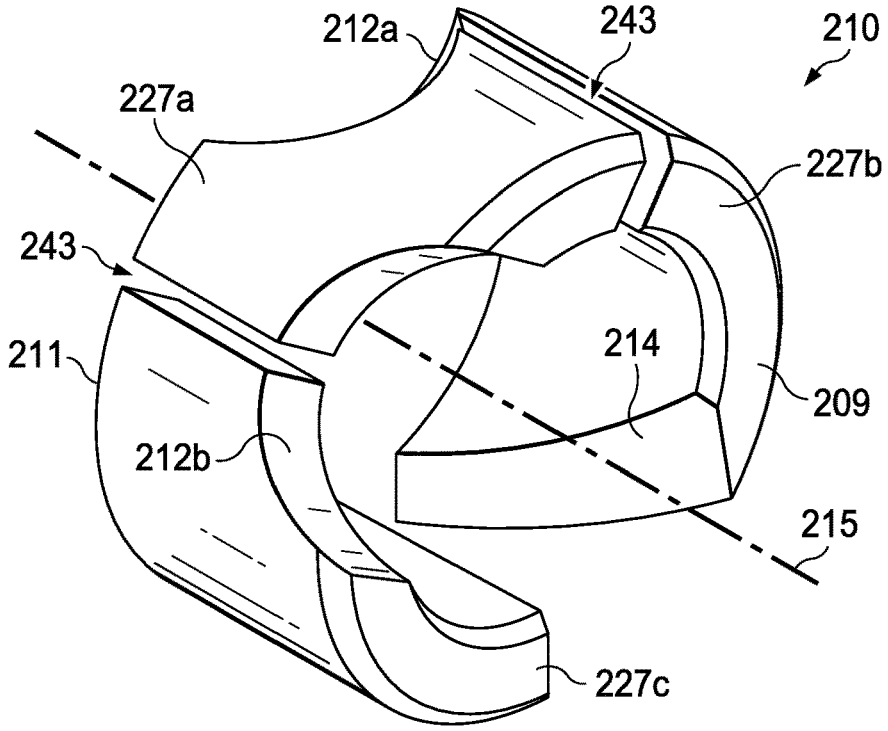
FIG. 10 is a perspective view of another segment of the segmented fill body of FIG. 5, according to one or more embodiments of the present disclosure.

Referring to FIG. 10, in an embodiment, the fill bodies 210 may each be formed in the general shape of a short sleeve or ring, much like that of the embodiment shown in FIGS. 7 and 8. However, as shown in FIG. 10, the fill bodies 210 may each be divided into annular portions, segments, or sections, generally referred to as wedges. More particularly, the fill bodies 210 may each comprise multiple segments such that each of the multiple segments is positioned partially around the charge tube 208 so that, in combination, the multiple segments are positioned completely around the charge tube 208. In this illustrated embodiment, the ring is formed of multiple fill body wedges 227*a*, 227*b*, and 227*c* that together cooperate to form one of the ring-shaped fill bodies 210. While the wedges 227*a*, 227*b*, and 227*c* may abut one another to form the fill body 210, in several embodiments, such as the illustrated embodiment, the individual wedges 227 are spaced apart from one another so as to form a radial gap or void 243 therebetween. In several embodiments, the radial gap or void 243 between the wedges 227 functions as a mechanism for reducing shock. The radial void 243 may be filled with a spacer material selected to create a shock impedance mismatch with respect to the shock impedance of the material forming the wedges 227*a*, 227*b*, and 227*c*. In some embodiments, such spacer material in the radial voids 243 may be low density solids, foams, the like, or any combination thereof. As shown in FIG. 10, each of the fill bodies 210 includes the opposing end portions 209 and 211, the partial recesses 212*a* and 212*b*, and the groove 214, as described above.

It will be appreciated that in addition to filling an annular space between a carrier tube and a charge tube, the fill bodies described herein can also be utilized to align the charge tube within the carrier tube. This is particularly desirable in instances where the charge tube has a small outer diameter and the carrier tube has a large inner diameter such that ensuring that the charge tube is coaxially aligned within the carrier tube is more difficult. Similarly, the fill bodies described herein can provide support and protection to the charge tube during deployment of the perforating gun.

Figure 11:
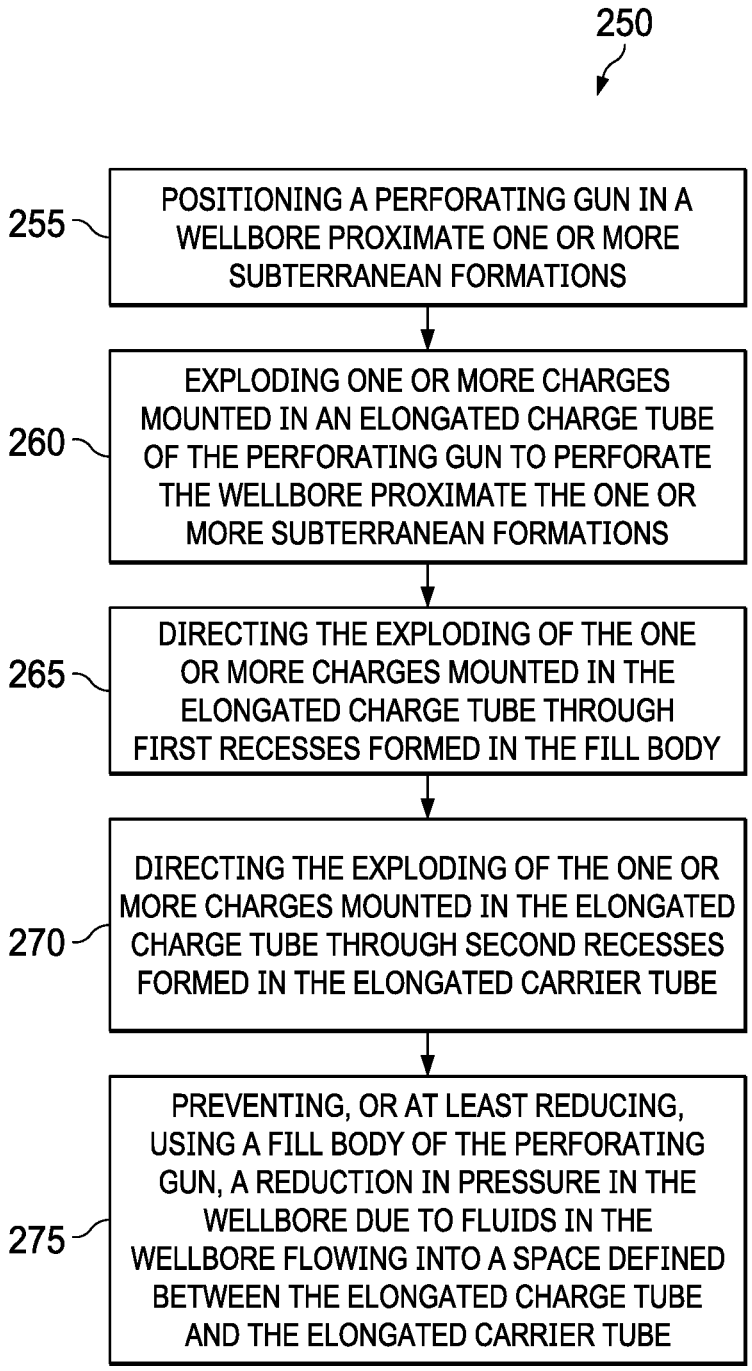
FIG. 11 is a is a flow diagram of a method for implementing one or more embodiments of the present disclosure.

Referring to FIG. 11, a method for perforating the wellbore is diagrammatically illustrated and generally referred to by the reference numeral 250. The method includes at a step 255, positioning a perforating gun in a wellbore proximate one or more subterranean formations. The perforating gun comprises: a charge tube in which one or more charges are mounted; a carrier tube in which the charge tube is positioned; and a fill body positioned within a space formed between the charge tube and the carrier tube. At a step 260, the one or more charges mounted in the charge tube are exploded to perforate the wellbore proximate the one or more subterranean formations. At a step 265, the exploding of the one or more charges mounted in the charge tube is directed through first recesses formed in the fill body. At a step 270, the exploding of the one or more charges mounted in the charge tube is directed through second recesses formed in the carrier tube. At a step 275, using the fill body, a reduction in pressure in the wellbore due to fluids in the wellbore flowing into the space defined between the charge tube and the carrier tube is prevented, or at least reduced.

In several embodiments, the execution of the method 250 and/or the operation of the well system 110, the perforating gun 112, and/or the perforating gun 200 prevents, or at least reduces: reductions in wellbore pressure after one or more charges explode; dynamic underbalance of a wellbore pressure as compared to a formation pressure. Additionally, the execution of the method 250 and/or the operation of the well system 110, the perforating gun 112, and/or the perforating gun 200 aligns the charge tube with the carrier tube to assist with perforation of a wellbore proximate one or more subterranean formations.

A perforating gun has been disclosed. The perforating gun generally includes a charge tube in which one or more charges are mounted, the one or more charges being detonable to perforate a wellbore proximate one or more subterranean formations; a carrier tube in which the charge tube is positioned; and a fill body positioned within a space defined between the charge tube and the carrier tube to decrease a free volume of the perforating gun.

In other embodiments, the perforating gun generally includes a fill body positionable within an annular space defined between a charge tube and a carrier tube of a perforating gun, the fill body comprising multiple segments positionable along a length of the perforating gun to decrease a free volume of the perforating gun; and a first recess positionable in alignment with a perforating charge mounted in the charge tube of the perforating gun and detonable to perforate a wellbore proximate a subterranean formation.

In other embodiments, the perforating gun generally includes an elongated charge tube in which one or more charges are mounted, the charge tube having an outer diameter; an elongated carrier tube within which the charge tube is axially disposed, the carrier tube having an inner diameter that is greater than the outer diameter of the charge tube so as to form an annular space between the carrier tube and the charge tube; and an annular fill body disposed between the charge tube and the carrier tube within the annular space.

In yet other embodiments, the perforating gun generally includes an elongated charge tube in which one or more charges are mounted, the charge tube having an outer diameter; an elongated carrier tube within which the charge tube is axially disposed, the carrier tube having an inner diameter that is greater than the outer diameter of the charge tube so as to form an annular space between the carrier tube and the charge tube; and a fill body disposed between the charge tube and the carrier tube within the annular space, wherein the fill body comprises an annular sleeve having an wall in which one or more recesses are formed, the sleeve disposed around the charge tube so that the one or more recesses are aligned with the one or more charges carried by the charge tube.

In still other embodiments, the perforating gun generally includes an elongated charge tube in which a first charge and a second charge are mounted, the charge tube having an outer diameter; an elongated carrier tube within which the charge tube is axially disposed, the carrier tube having an inner diameter that is greater than the outer diameter of the charge tube so as to form an annular space between the carrier tube and the charge tube; a first fill body disposed between the charge tube and the carrier tube within the annular space, wherein the first fill body comprises an annular ring having a first end and a second end with a recess formed in the first end and a recess formed in the second end, the ring disposed around the charge tube so that one recess is adjacent the first charge and the other recess is adjacent the second charge.

The foregoing embodiments may include one or more of the following elements, either alone or in combination with one another:

The fill body comprises multiple tubes; adjacent ones of the multiple tubes are spaced apart from one another to form voids therebetween; a first material is positioned within each of the voids, said first material having a first shock impedance; the fill body is made of a second material having a second shock impedance that is different from the first shock impedance; and the difference between the first shock impedance of the first material and the second shock impedance of the second material mitigates shock caused by the one or more charges exploding.

First recesses are formed in the fill body, said first recesses being positioned adjacent each of the one or more charges mounted in the charge tube.

The fill body comprises multiple tubes; each of the multiple tubes defines opposing first and second end portions; and at least one of the first recesses comprises a first partial recess formed in the first end portion of one of the multiple tubes and a second partial recess formed in the second end portion of one of the multiple tubes.

Second recesses are formed in the carrier tube; and the second recesses in the carrier tube are at least partially aligned with the first recesses in the fill body.

The fill body comprises multiple segments; and each of the multiple segments is positioned partially around the charge tube so that, in combination, the multiple segments are positioned completely around the charge tube.

Adjacent ones of the multiple segments are spaced apart from one another to form voids therebetween; a first material is positioned within each of the voids, said first material having a first shock impedance; the fill body is made of a second material having a second shock impedance that is different from the first shock impedance; and the difference between the first shock impedance of the first material and the second shock impedance of the second material mitigates shock caused by the one or more charges exploding.

The annular fill body is sleeve.

The carrier tube, the charge tube and the sleeve are each formed of a wall having a thickness, and wherein the wall thickness of the sleeve is greater than the wall thickness of either the carrier tube or the charge tube.

The charge tube has an outer diameter, the carrier tube has an inner diameter and the annular fill body has an inner diameter and an outer diameter, wherein the inner diameter of the annular fill body is equal to or greater than the outer diameter of the charge tube and the outer diameter of the annular fill body is equal to or smaller than the inner diameter of the carrier tube.

The inner diameter of the annular fill body is larger than the outer diameter of the charge tube so as to form an annular gap between the charge tube and the annular fill body.

The outer diameter of the annular fill body is less than the inner diameter of the carrier tube so as to form an annular gap between the carrier tube and the annular fill body.

The sleeve comprises a first sleeve formed of a first material and as second sleeve formed of a second material different than the first material, wherein the first sleeve overlies a charge in the charge tube.

A cavity formed in the sleeve wall opposite the recess.

A detonation mechanism carried by the charge tube adjacent a charge, the detonation mechanism extending into the cavity.

The fill body comprises a first annular segment and a second annular segment which together cooperate to extent around a perimeter of the charge tube.

The fill body comprises a first annular segment, a second annular segment and a third annular segment which together cooperate to extent around a perimeter of the charge tube.

A second fill body disposed between the charge tube and the carrier tube within the annular space, wherein the second fill body comprises an annular ring having a first end and a second end with a recess formed in the first end and a recess formed in the second end, the ring disposed around the charge tube adjacent the first fill body so that adjacent recesses of the first and second fill bodies encircle the first charge and the other recess of one of the fill bodies is adjacent the second charge.

A method has also been disclosed. The method generally includes: positioning a perforating gun in a wellbore proximate one or more subterranean formations, the perforating gun comprising: a charge tube in which one or more charges are mounted; a carrier tube in which the charge tube is positioned; and a fill body positioned within a space formed between the charge tube and the carrier tube; exploding the one or more charges mounted in the charge tube to perforate the wellbore proximate the one or more subterranean formations; and preventing, or at least reducing, using the fill body, a reduction in pressure in the wellbore due to fluids in the wellbore flowing into the space defined between the charge tube and the carrier tube.

The foregoing method embodiment may include one or more of the following elements, either alone or in combination with one another:

The fill body comprises multiple tubes; adjacent ones of the multiple tubes are spaced apart from one another to form voids therebetween; a first material is positioned within each of the voids, said first material having a first shock impedance; the fill body is made of a second material having a second shock impedance that is different from the first shock impedance; and the method further comprises mitigating shock caused by the one or more charges exploding via the difference between the first shock impedance of the first material and the second shock impedance of the second material.

First recesses are formed in the fill body, said first recesses being positioned adjacent each of the one or more charges mounted in the charge tube; and the method further comprises directing the exploding of the one or more charges mounted in the charge tube through the first recesses formed in the fill body.

The fill body comprises multiple tubes; each of the multiple tubes defines opposing first and second end portions; and at least one of the first recesses comprises a first partial recess formed in the first end portion of one of the multiple tubes and a second partial recess formed in the second end portion of one of the multiple tubes.

Second recesses are formed in the carrier tube; the second recesses in the carrier tube are at least partially aligned with the first recesses in the fill body; and the method further comprises directing the exploding of the one or more charges mounted in the charge tube through the second recesses formed in the carrier tube.

The fill body comprises multiple segments; and each of the multiple segments is positioned partially around the charge tube so that, in combination, the multiple segments are positioned completely around the charge tube.

Adjacent ones of the multiple segments are spaced apart from one another to form voids therebetween; a first material is positioned within each of the voids, said first material having a first shock impedance; the fill body is made of a second material having a second shock impedance that is different from the first shock impedance; and the method further comprises mitigating shock caused by the one or more charges exploding via the difference between the first shock impedance of the first material and the second shock impedance of the second material.

Another apparatus has also been disclosed. The another apparatus generally includes: a fill body positionable within a space defined between a charge tube, in which one or more charges are mounted, and a carrier tube, in which the charge tube is positioned; wherein, when the fill body is positioned within the space defined between the charge tube and the carrier tube: the one or more charges mounted in the charge tube are detonable to perforate a wellbore proximate one or more subterranean formations; and after the one or more charges are detonated to perforate the wellbore proximate the one or more subterranean formations, the fill body is configured to prevent, or at least reduce, a reduction in pressure in the wellbore due to fluids in the wellbore flowing into the space defined between the charge tube and the carrier tube.

The foregoing apparatus embodiment may include one or more of the following elements, either alone or in combination with one another:

The fill body comprises multiple tubes; adjacent ones of the multiple tubes configured to be spaced apart from one another to form voids therebetween; a first material is positionable within each of the voids, said first material having a first shock impedance; the fill body is made of a second material having a second shock impedance that is different from the first shock impedance; and, when the adjacent ones of the multiple tubes are spaced apart from one another to form the voids therebetween and the first material is positioned within each of the voids, the difference between the first shock impedance of the first material and the second shock impedance of the second material is configured to mitigate shock when the one or more charges explode.

First recesses are formed in the fill body, said first recesses being positionable adjacent each of the one or more charges mounted in the charge tube.

The fill body comprises multiple tubes; each of the multiple tubes defines opposing first and second end portions; and at least one of the first recesses comprises a first partial recess formed in the first end portion of one of the multiple tubes and a second partial recess formed in the second end portion of one of the multiple tubes.

The fill body comprises multiple segments; and each of the multiple segments is positionable partially around the charge tube so that, in combination, the multiple segments are positioned completely around the charge tube.

Adjacent ones of the multiple segments are configured to be spaced apart from one another to form voids therebetween; a first material is positionable within each of the voids, said first material having a first shock impedance; the fill body is made of a second material having a second shock impedance that is different from the first shock impedance; and, when the multiple segments are spaced apart from one another to form the voids therebetween and the first material is positioned within each of the voids, the difference between the first shock impedance of the first material and the second shock impedance of the second material is configured to mitigate shock when the one or more charges explode.

It is understood that variations may be made in the foregoing without departing from the scope of the present disclosure.

In several embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

What is claimed is:

1. A perforating gun positionable into a wellbore, the perforating gun comprising:

a charge tube in which a perforating charge is mounted, wherein the charge tube has a first outer diameter and a first wall thickness, and wherein the perforating charge is detonable in the wellbore;

a carrier tube in which the charge tube is positioned, wherein the carrier tube has a first inner diameter that is greater than the first outer diameter of the charge tube to form an annular space between the carrier tube and the charge tube;

and a fill body positioned within the annular space between the charge tube and the carrier tube to decrease a free volume of the perforating gun, wherein the fill body has a second wall thickness that is greater than the first wall thickness, wherein the fill body defines a recess adjacent the perforating charge, wherein the fill body is or includes a first material, wherein the recess is at least partially filled with a cover, which cover is or includes a second material that is different from the first material, and wherein the fill body is adapted to mitigate pressure drawdown within the wellbore after the perforating charge is detonated in the wellbore.

2. The perforating gun of claim 1, wherein the cover includes a central aperture.

3. The perforating gun of claim 1, wherein the fill body defines a cavity inside the second wall thickness.

4. The perforating gun of claim 1, wherein the fill body has a second inner diameter that is greater than first outer diameter of the charge tube to form an annular gap between the charge tube and the fill body, thereby diminishing a shock coupling between the perforating charge, the charge tube, and the carrier tube when the perforating charge is detonated in the wellbore.

5. The perforating gun of claim 1, wherein the fill body has a second outer diameter that is less than the first inner diameter of the carrier tube to form an annular gap between the charge tube and the fill body, thereby diminishing a shock coupling between the perforating charge, the charge tube, and the carrier tube when the perforating charge is detonated in the wellbore.

6. The perforating gun of claim 1, wherein the fill body comprises multiple segments.

7. A perforating gun positionable into a wellbore, the perforating gun comprising:

a charge tube in which a perforating charge is mounted, wherein the charge tube has a first outer diameter, and wherein the perforating charge is detonable in the wellbore;

a carrier tube in which the charge tube is positioned, wherein the carrier tube has a first inner diameter that is greater than the first outer diameter of the charge tube to form an annular space between the carrier tube and the charge tube;

a fill body positioned within the annular space between the charge tube and the carrier tube to decrease a free volume of the perforating gun, wherein the fill body is adapted to mitigate pressure drawdown within the wellbore after the perforating charge is detonated in the wellbore; and a detonation cord ballistically connected to the perforating charge;

wherein the fill body define a groove that accommodates the detonation cord; and wherein the detonation cord is adapted to transfer a detonation train along the perforating gun to detonate the perforating charge in the wellbore.

8. The perforating gun of claim 7, wherein the groove extends helically along a length of the fill body.

9. The perforating gun of claim 7, wherein the fill body defines a recess adjacent the perforating charge, wherein the fill body is or includes a first material, and wherein the recess is at least partially filled with a cover, which cover is or includes a second material that is different from the first material.

10. The perforating gun of claim 9, wherein the cover includes a central aperture.

11. The perforating gun of claim 7, wherein the fill body comprises multiple segments.

12. The perforating gun of claim 11, wherein the segments are spaced apart from one another along the length of the perforating gun.

13. A method, comprising:

positioning a perforating gun into a wellbore, the perforating gun comprising:

a charge tube in which a perforating charge is mounted, wherein the charge tube has an outer diameter and a first wall thickness, and wherein the perforating charge is detonable in the wellbore;

a carrier tube in which the charge tube is positioned, wherein the carrier tube has an inner diameter that is greater than the outer diameter of the charge tube to form an annular space between the carrier tube and the charge tube;

and a fill body positioned within the annular space between the charge tube and the carrier tube to decrease a free volume of the perforating gun, wherein the fill body has a second wall thickness that is greater than the first wall thickness;

wherein the fill body defines a recess adjacent the perforating charge, wherein the fill body is or includes a first material, wherein the recess is at least partially filled with a cover, which cover is or includes a second material that is different from the first material, detonating the perforating charge in the wellbore;

and after detonating the perforating charge in the wellbore, mitigating, using the fill body, pressure drawdown within the wellbore.

14. The method of claim 13, wherein the cover includes a central aperture.

15. The method of claim 13, wherein the fill body defines a cavity inside the second wall thickness.

16. The method of claim 13, wherein the fill body has a second inner diameter that is greater than first outer diameter of the charge tube to form an annular gap between the charge tube and the fill body, thereby diminishing a shock coupling between the perforating charge, the charge tube, and the carrier tube when the perforating charge is detonated in the wellbore.

17. The method of claim 13, wherein the fill body has a second outer diameter that is less than the first inner diameter of the carrier tube to form an annular gap between the charge tube and the fill body, thereby diminishing a shock coupling between the perforating charge, the charge tube, and the carrier tube when the perforating charge is detonated in the wellbore.

18. The method of claim 13, wherein the perforating gun further comprises:

a detonation cord ballistically connected to the perforating charge;

wherein the fill body defines a groove that accommodates the detonation cord;

and wherein detonating the perforating charge in the wellbore comprises transferring, via the detonation cord, a detonation train along the perforating gun.

19. The method of claim 18, wherein the groove extends helically along a length of the fill body.

20. The method of claim 13, wherein the fill body comprises multiple segments.

* * * * *